United States Patent [19]

Houghton et al.

[11] 4,028,802

[45] June 14, 1977

[54] LOOP CUTTING TOOL

[75] Inventors: George L. Houghton, Santa Ana; Fred F. Fredensberg, Newport Beach, both of Calif.

[73] Assignee: Rug Crafters, Santa Ana, Calif.

[22] Filed: Nov. 6, 1975

[21] Appl. No.: 629,325

[52] U.S. Cl. ..... 30/294; 30/DIG. 8

[51] Int. Cl.[2] ..... B26B 5/00; B26B 29/00

[58] Field of Search ..... 30/296 R, 296 A, 290, 30/287, 288, 299, DIG. 8, 294, 286, 289, 291

[56] References Cited

UNITED STATES PATENTS

| | | | |
|---|---|---|---|
| 1,192,748 | 7/1916 | Bundy | 30/286 |
| 2,283,017 | 5/1942 | Scott | 30/294 X |
| 2,636,245 | 4/1953 | Stout | 30/294 X |
| 2,696,621 | 12/1954 | Miller | 30/DIG. 8 |
| 3,230,620 | 1/1966 | Embleton | 30/294 X |

*Primary Examiner*—Al Lawrence Smith
*Assistant Examiner*—J. T. Zatarga
*Attorney, Agent, or Firm*—Gordon L. Peterson

[57] ABSTRACT

A loop cutting tool comprising a body member of sheet material having an elongated nose at one end and a handle at the other end. A region of the sheet material of the body member is deformed to define a blade supporting section which includes a side wall and a ledge. A blade is positioned on the ledge against the side wall with the cutting edge of the blade being exposed. A guard is mounted on the body member and is positionable over the cutting edge of the blade.

11 Claims, 6 Drawing Figures

LOOP CUTTING TOOL

BACKGROUND OF THE INVENTION

Shag rugs can be made by forming loops of yarn on a suitable backing material and then cutting the loops. In the case of the home craftsman, the loops may be formed manually, for example, by using a manually operable tufting tool of the type shown in U.S. Pat. No. 3,714,915. The loops are then cut with scissors to form the shag rug. Loop cutting with scissors is time consuming, difficult, and very tiring.

Various tools are known for cutting bands, packages, and envelopes. However, none of these tools are adapted for loop cutting, and they are generally difficult, and relatively costly, to make. For example, tools of the type shown in U.S. Pat. Nos. 3,230,620, 2,610,399, 2,434,639, and 1,268,997 provide a full channel for receiving the blade, and this adds to the cost of manufacture. In addition, the full channel complicates blade retention as shown for example by U.S. Pat. No. 3,230,620 where three separate screws are required to hold the blade properly in the channel.

U.S. Pat. No. 2,681,502 shows a safety box opener in which the blade is not mounted in a channel. However, this tool is totally and obviously unsuited for loop cutting.

Another problem with prior art cutting tools is that many of them are not adapted for use with commercially available blades. U.S. Pat. Nos. 2,389,648 and 3,230,620 are exemplary of tools which are designed for use with nonstandard blades.

SUMMARY OF THE INVENTION

The present invention provides an inexpensive cutting tool which is adapted to cut loops. The loop cutting tool of this invention uses a standard blade.

The present invention reduces the cost of manufacture and facilitates assembly by eliminating the conventional full channel for mounting the blade. With this invention, the blade is mounted in a recess having one open side. A one-sided recess is much easier to make than the conventional channel. In addition, because one entire side of the recess is open, it is very easy to mount the blade on the tool.

This concept can be implemented, for example, by providing a body member of sheet material. The body member has an elongated nose at one end, a guiding edge, and a handle at the other end of the body member.

The one-sided recess can advantageously be provided by deforming a region of the sheet material of the body member between the handle and the nose to define a blade supporting section. The blade supporting section includes a single side wall and a ledge which cooperate to define the recess with the open side.

The blade supporting section is integral with the remainder of the body member. Various techniques can be used to form the blade supporting section; however, coining is preferred because it results in minimum deformation of the material out of the plane of the body member and it provides a sharp corner between the ledge and the side wall.

The cutting tool is adapted to use a standard, commercially available blade. The blade may have first and second opposite sides, a cutting edge, and a noncutting edge.

The blade can advantageously be attached to the side wall of the blade supporting section. This results in the first side of the blade confronting the side wall, the noncutting edge confronting the ledge, the cutting edge being exposed, the second side of the blade being exposed through the open side of the recess, and the cutting edge forming an acute angle with the guiding edge.

Only a single screw and a cooperating nut are required to attach the blade to the side wall. Although the nut may be formed in different ways, it can advantageously be formed by internally threading a portion of the side wall.

In using the tool of this invention, the nose is inserted into a number of the loops to be cut, and the guiding edge is slid along the backing material of the rug. This causes the loops to sequentially ride up on the inclined cutting edge of the blade resulting in automatic sequential severance of the loops.

The cutting edge of the blade extends substantially to an edge of the nose. In using the tool, yarn sometimes slips beneath the blade adjacent the intersection of the nose and the cutting edge. The yarn may become caught between the blade and the side wall, and this temporarily stops the loop cutting process.

The present invention solves this problem by providing means adjacent the intersection of the cutting edge and the nose for cooperating with the side wall and the ledge to define a channel for receiving the region of the blade lying closely adjacent the nose. This channel is preferably very small and located only at the leading edge of the blade. The channel causes the loops to ride over the transition region between the nose and the blade and prevents yarn from being caught between the blade and the body member. In addition, it assists in mounting the blade. Although various means could be utilized to carry out this function, in a preferred form of the invention, a rivet is attached to the body member with the head of the rivet cooperating with the side wall and the ledge to define the channel.

The ledge can support whatever length of the noncutting edge is required for the cutting operation. For optimum blade support, the ledge preferably extends for substantially the full length of the noncutting edge.

To guard against injury, the tool includes a guard. Although the guard may be attached to the tool in different ways, it can advantageously be pivotally mounted on the body member for movement between a safe position in which it covers at least a portion of the cutting edge and an open position in which at least a substantial portion of the cutting edge is exposed. For loop cutting, the guard should remain in whatever position it is placed. This can be accomplished by providing adequate frictional resistance between the guard and the body member.

Although the guard can take many different forms, it can advantageously be in the form of a relatively narrow channel. The guard need not receive the screw which attaches the blade to the side wall, and accordingly the channel need only be sufficiently wide to receive the cutting edge of the blade.

The invention can best be understood by reference to the following description taken in connection with the accompanying illustrative drawing.

DESCRIPTION OF THE PREFERRED EMBODIMENT

Figure 1:
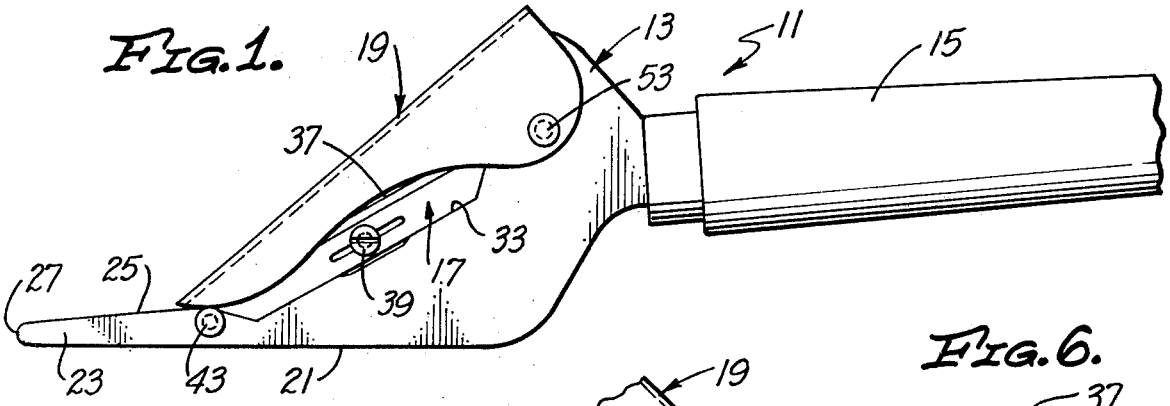
FIG. 1 is a fragmentary side elevational view of a cutting tool constructed in accordance with the teachings of this invention with the guard in the safe position.

FIG. 1 shows a loop cutting tool 11 which generally includes a body member 13, a handle 15 suitably attached to one end of the body member, a blade 17 mounted on the body member, and a guard 19. The body member 13 is preferably constructed of rigid sheet material such as aluminum or an aluminum alloy. The body member 13 has a flat bottom or guiding edge 21. The forward end portion of the body member 13 forms an elongated nose 23 having an upper or second edge 25 and a smoothly rounded forward end portion 27. The upper edge 25 diverges away from the guiding edge 21 as it progresses rearwardly, i.e. toward the handle 15.

Figure 4:
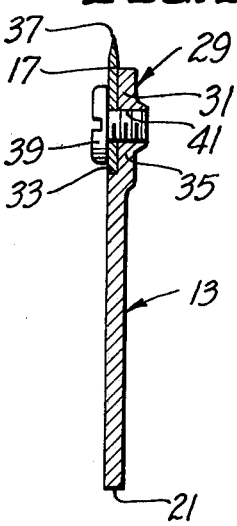
FIG. 4 is an enlarged sectional view taken generally along line 4—4 of FIG. 2.
Figure 5:
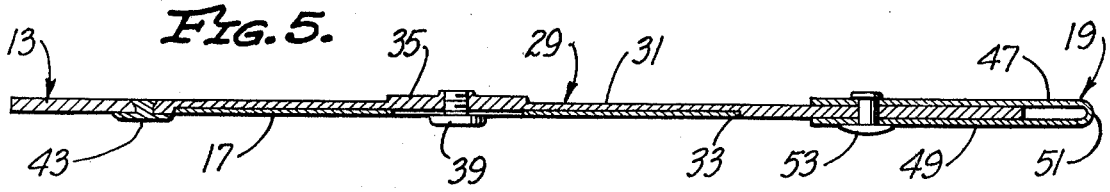
FIG. 5 is an enlarged sectional view taken generally along line 5—5 of FIG. 2.

A region of the body member 13 between the handle 15 and the nose 23 is deformed to define a blade supporting section 29 (FIGS. 4 and 5). The blade supporting section 29 includes a single side wall 31 and a ledge 33. The single side wall 31 and the ledge 33 define a one-sided or open sided recess for receiving the blade 17. The side wall 31 includes a mounting section 35 which is used to mount the blade 17. As shown in FIG. 5, the mounting section 35 is preferably thicker than the remainder of the side wall 31 and it projects slightly out of the plane of the remainder of the body member 13 as shown in FIGS. 4 and 5.

Although the blade supporting section 29 can be made in different ways, it is preferably made in a coining operation. This can be accomplished by compressively loading the side wall 31, except for the mounting section 35, across its thickness with the compressive loading being sufficient to cause metal flow and consequent thinning of the side wall 31. For this reason, the side wall 31 is of lesser thickness than the other portions of the body member 13. The coining operation provides a sharp corner between the side wall 31 and the ledge 33 to better support the blade 17. The mounting section 35 is slightly offset and is not coined so that it retains its original thickness.

The blade 17 has a standard, commercially available blade. The blade 17 has a cutting edge 37 with the balance of the periphery of the blade 17 forming a noncutting edge. The blade 17 is placed in the open-sided recess formed by the side wall 31 and the ledge 33, and it is suitably attached to the side wall 31 by a screw 39 which passes through the blade and enters the mounting section 35. The interior of the mounting section 35 is internally threaded to form a nut 41 for cooperating with the screw 39 to mount the blade 17 on the body member 13. Of course, a separate nut could be used, if desired. The screw 39 and the nut 41 are the only two elements which attach the blade 17 to the side wall 31.

With the blade 17 mounted on the body member 13, one side of the blade is held in tight engagement with the side wall 31 while substantially all of the other side of the blade 17 is exposed. The cutting edge 37 is exposed unless it is covered by the guard 17. The ledge 33 preferably extends for substantially the full length of the noncutting edge of the blade. The ledge 33 engages the noncutting edge of the blade and further supports the blade 17. An elongated portion of the ledge 33 is substantially parallel to the cutting edge 37.

Figure 2:
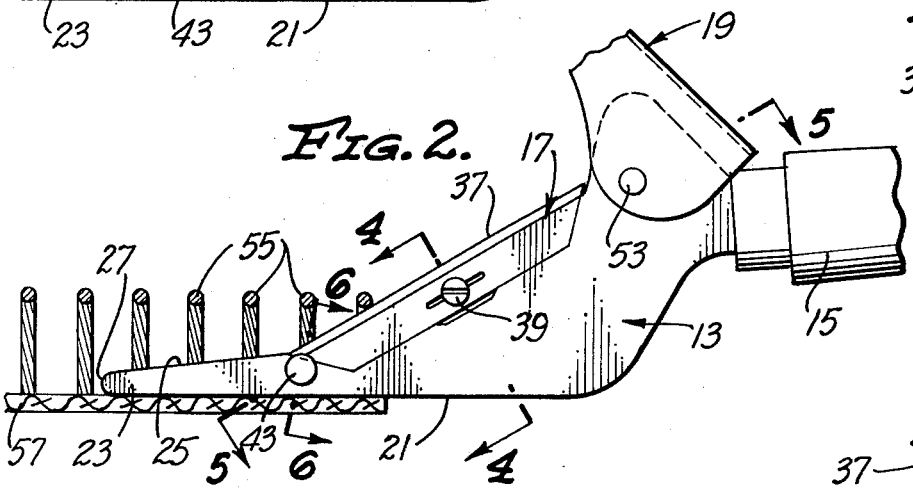
FIG. 2 is a fragmentary side elevational view of the cutting tool being used to cut loops.

The cutting edge 37 forms an acute angle with the guiding edge 21 as best shown in FIG. 2. The cutting edge 37 is inclined upwardly (as viewed in FIG. 2) at a greater angle than the edge 25. The angle formed by the cutting edge 37 and the guiding edge 21 can vary, but it is preferably in the range of 25° to 35° with about 30° being considered optimum.

Figure 6:
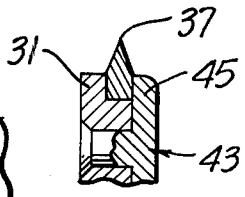
FIG. 6 is a fragmentary sectional view taken generally along line 6—6 of FIG. 2.

As best seen in FIG. 2, the cutting edge 37 substantially intersects the upper edge 25. To prevent yarn from catching on the forward end of the blade 17 between the blade and the body member 13, a rivet 43 is attached to the body member 13. As shown in FIG. 6, the rivet 43 has a head 45 which cooperates with the ledge 33 and the side wall 31 to define a channel for receiving the blade 17. Although means other than the rivet 43 could be used to form this channel, the rivet is preferred because of its simplicity, low cost, and ease of assembly. The channel thus formed prevents yarn from being trapped between the body member 13 and the blade 17. In addition the head 45 of the rivet 43 tends to cause the yarn to ride smoothly across the transition from the upper edge 25 to the cutting edge 37.

The handle 15 may be integral with the body member 13 or separate unit attached in a conventional manner to the body member. In the embodiment illustrated, the handle 15 is a separate element having a smooth cylindrical or frustoconical surface. For optimum comfort of the user, the longitudinal axis of the handle 15 preferably forms a small acute angle with the guiding ledge 21.

Although the guard 19 could be of various configurations, in the embodiment illustrated, it is of generally channel-shaped cross section and includes legs 47 and 49 interconnected by a web 51 (FIG. 5). The guard 19 is pivotally mounted on the body member 13 by a rivet 53. As shown in FIG. 5, the guard 19 receives a portion of the body member 13.

Figure 3:
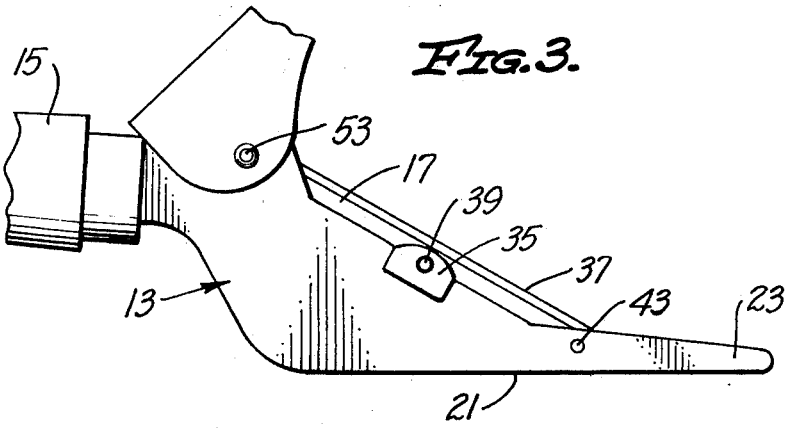
FIG. 3 is a fragmentary side elevational view of the cutting tool showing the opposite side of the tool.

The guard 19 is pivotable about the rivet 53 from a safe position shown in FIG. 1 in which it receives a substantial portion of the cutting edge 37 to an open position shown in FIGS. 2, 3 and 5 in which substantially all of the cutting edge 37 is exposed. The channel formed by the guard 19 is very thin as shown in FIG. 5 and is too thin to receive the screw 39. The guard 19 cannot be pivoted counterclockwise beyond the position shown in FIG. 1 because the outer end of the guard engages the rivet 43.

The tool 11 is adapted for cutting loops such as loops 55 which have been formed on backing material 57. The nose 23 is inserted within the tunnel formed by the backing material 57 and the loops 55. As the tool 11 is advanced, a first of the loops 55 engages the cutting edge 37 and rides up on it until such loop is cut. Each of the other loops are sequentially cut in the same manner. A length of the nose 23 which will accommodate five to seven loops has been found optimum. The rounded forward end portion 27 of the nose 23 prevents the end of the nose from catching on the fibers of the backing material 57 or the loops 55.

Although an exemplary embodiment of the invention has been shown and described, many changes, modifications and substitutions may be made by those with ordinary skill in the art without necessarily departing from the spirit and scope of this invention.

We claim:

1. A loop cutting tool for cutting loops comprising:

a body member of sheet material, said body member having an elongated nose at one end of the body member and a guiding edge forming one edge of said nose, said nose having a second edge;

handle means on the body member at the other end thereof;

a region of the sheet material of said body member between said handle means and said elongated nose defining a blade supporting section, said blade supporting section including a side wall and a ledge and having a recess with a substantially open side with said side wall being opposite said open side and said ledge extending along an edge of the recess;

a blade having first and second opposite sides, a cutting edge, and a noncutting edge;

means for attaching said blade to said side wall with said blade being received in said recess, said first side of said blade confronting said side wall, at least a portion of said noncutting edge confronting said ledge, said cutting edge being exposed and extending substantially to the second edge, said second side of said blade being exposed through the open side of said recess, and said cutting edge forming an acute angle with said guiding edge;

means adjacent the intersection of said cutting edge and said second edge cooperating with said side wall and said ledge to define a channel for receiving the region of said blade lying closely adjacent said second edge and for preventing the material of the loops from being caught between the blade and the body member during use of the tool; and a guard positionable over said cutting edge.

2. A loop cutting tool as defined in claim 1 wherein in one orientation of the loop cutting tool the guiding edge forms the bottom edge of the body member and the elongated nose, and the second edge forms an upper edge of said elongated nose, said cutting edge is inclined upwardly at a greater angle than said upper edge in said one orientation of the cutting tool.

3. A loop cutting tool as defined in claim 1 wherein said attaching means consists of a single screw extending through said blade and into said side wall and means defining a nut cooperating with said screw.

4. A loop cutting tool as defined in claim 1 wherein said last mentioned means includes a rivet attached to said body member, said rivet having a head which cooperates with said side wall and said ledge to define said channel.

5. A loop cutting tool as defined in claim 1 wherein said ledge extends for substantially the full length of said noncutting edge, a portion of the ledge being substantially parallel to said cutting edge.

6. A loop cutting tool as defined in claim 1 including means for pivotally mounting said guard on the body member for movement between a safe position in which the guard covers at least a substantial portion of said cutting edge and an open position in which at least a substantial portion of the cutting edge is exposed, the frictional resistance to such movement being sufficient to maintain the guard in whichever of said positions it is placed in.

7. A loop cutting tool as defined in claim 1 wherein said blade supporting section is a coined section.

8. A loop cutting tool as defined in claim 1 wherein said guard includes a channel-shaped section pivotally mounted on said body member and said attaching means includes a screw extending into both of said blade and said side wall, said guard being pivotable to a safe position in which it covers a portion of said cutting edge, the width dimension of the channel-shaped section being insufficient to receive said screw.

9. A loop cutting tool adapated for use with a blade having first and second opposite sides, a cutting edge, and a noncutting edge, said loop cutting tool comprising:

a body member of sheet material, said body member having an elongated nose at one end of the body member and a guiding edge forming one edge of said nose, said nose having a second edge;

handle means on the body member at the other end thereof;

a region of the sheet material of said body member between said handle means and said elongated nose being deformed to define a blade supporting section, said blade supporting section including a side wall and a ledge and having a recess with a substantially open side with said side wall being opposite said open side and said ledge extending along an edge of the recess;

means for attaching said blade to said side wall so that the blade is received in the recess, the first side of said blade confronts said side wall, at least a portion of the noncutting edge confronts said ledge, the cutting edge is exposed, the second side of the blade is exposed through the open side of said recess, and the cutting edge forms an acute angle with said guiding edge;

means adjacent said second edge cooperating with said side wall and said ledge to define a channel for receiving a region of the blade adjacent the second edge and the cutting edge and for preventing the material of the loops from being caught between the blade and the body member during use of the tool; and a guard mounted on the body member.

10. A loop cutting tool as defined in claim 9 wherein said attaching means consists of a single screw extending through said blade and into said side wall and means defining a nut cooperating with said screw.

11. A loop cutting tool as defined in claim 9 wherein said last mentioned means includes a rivet attached to said body member, said rivet having ahead which cooperates with said side wall and said ledge to define said channel.

* * * * *